United States Patent [19]

Kaeser

[11] 4,294,718

[45] Oct. 13, 1981

[54] NON-GELLING INORGANIC SALT CRUTCHER SLURRIES

[75] Inventor: James A. Kaeser, Somerset, N.J.

[73] Assignee: Colgate-Palmolive Company, New York, N.Y.

[21] Appl. No.: 128,574

[22] Filed: Mar. 10, 1980

[51] Int. Cl.[3] ..... C11D 3/04; C11D 7/14

[52] U.S. Cl. ..... 252/135; 252/89.1; 252/174.13; 252/174.14

[58] Field of Search ..... 252/135, 174.14, 174.19, 252/89.1

[56] References Cited

U.S. PATENT DOCUMENTS

| | | | |
|---|---|---|---|
| 3,594,323 | 7/1971 | Taylor et al. | 252/826 |
| 3,801,511 | 4/1974 | Lemoff | 252/135 |
| 3,893,955 | 7/1975 | Hewitt et al. | 252/551 |
| 3,915,903 | 10/1975 | Wise | 252/552 |
| 4,075,117 | 2/1978 | Morton et al. | 252/135 |

FOREIGN PATENT DOCUMENTS

| | | | |
|---|---|---|---|
| 2003913A | 3/1979 | United Kingdom | 252/91 |

*Primary Examiner*—Mayer Weinblatt
*Attorney, Agent, or Firm*—Kenyon & Kenyon

[57] ABSTRACT

Gelation and setting of desirably miscible and pumpable crutcher slurries comprising sodium carbonate, sodium bicarbonate and sodium silicate in an aqueous medium are retarded and often prevented by the addition to such medium of a citric material, such as citric acid and/or water soluble citrate, and magnesium sulfate. Alternatively, magnesium citrate may be employed. The addition of the citric material and magnesium sulfate (or magnesium citrate) lengthens appreciably the workable crutcher time before setting, increasing it over such working time for similar crutcher mixes containing the citric material but not containing magnesium sulfate. The improved workability of the crutcher mix permits the making of higher solids content crutcher slurries, thereby resulting in significant energy savings and increases in production rates when the crutcher slurries are subsequently spray dried to free flowing inorganic salt base bead form, from which detergent compositions may be made by post-spraying with nonionic synthetic organic detergent in liquid state.

22 Claims, No Drawings

NON-GELLING INORGANIC SALT CRUTCHER SLURRIES

The present invention relates to non-gelling aqueous slurries of inorganic salt mixtures and to methods for their manufacture. More particularly, it relates to the utilization of certain materials, which, in combination, exert an exceptionally good and improved anti-gelling action, preventing gelation, excess thickening and setting up of bicarbonate-carbonate-silicate slurries, from which particulate heavy duty synthetic organic detergent compositions may be made, as by spray drying and post-spraying.

Built synthetic organic detergent compositions in free flowing particulate bead form have been well known heavy duty laundry products for years. Recently, limitations have been placed on the use of polyphosphate builder salts, such as pentasodium tripolyphosphate, due to alleged detrimental ecological effects thereof, and nonionic synthetic organic detergents of improved detergency and other desirable properties have been made and have partially replaced the previously dominant anionic detergents in household washing products. Nonionic detergents are often adversely affected by spray drying temperatures and the "pluming" of drying towers in which they are being processed is environmentally objectionable. Accordingly, some household laundry detergent compositions are now made by spray drying inorganic builder salt mixtures, devoid of organic detergent, and subsequently spraying onto the surfaces of the resulting spray dried beads a nonionic detergent in liquid state so that it is absorbed by the beads. It has been found that base beads which are satisfactorily absorptive of liquid nonionic detergent can be made from mixtures of alkali metal bicarbonate, alkali metal carbonate and alkali metal silicate, which apparently owe at least some of their absorbency to the nature of the bead made, which in turn, appears to be due to the partial decomposition of bicarbonate to carbonate during the spray drying operation. The silicate in such base beads helps make the bead firmer and more resistant to powdering and crushing, helps prevent corrosion of aluminum parts and contributes detergent building properties to the composition. However, it has been found that aqueous crutcher mixes containing substantial proportions of bicarbonate, carbonate and silicate tend to gel or set prematurely, sometimes before they can be thoroughly mixed and pumped out of a crutcher to spray towers, and consequently, extensive experimentation has been undertaken in an effort to find ways to diminish the tendencies of such systems to solidify or gel in the crutcher.

While various ways may be employed to diminish gelation, the most dramatic successes have been found to result from the use of small quantities of particular additives, which are surprisingly effective in preventing or retarding gelation. Thus, prior to the present invention it had been discovered by a fellow researcher of the present inventor that small quantities of citric acid or water soluble citrate incorporated in the crutcher mix could delay or prevent gelation and setting of bicarbonate-carbonate-silicate mixes and would allow commercial spray drying thereof, following normal procedures for pumping out the crutcher contents to the spray nozzles. However, while such invented process was and is successful, it has been supplanted by the present one, which represents a significant improvement over it because the anti-gelling effect is greater with the present combination of citric material and magnesium sulfate than it is with the citric material alone. (The term "citric material" includes citric acid and water soluble derivatives thereof, e.g., water soluble salts). In addition to improving the anti-gelling activity and increasing the length of time in which a crutcher mix will be workable without the need for significantly larger proportions of anti-gelling agent being incorporated, the present invention allows the use of a lesser proportion of organic material, thereby decreasing the likelihood of the spray dried composition deteriorating in the heat of the dryer and improving the absorbency and flowability of the product. Also, whereas the citric acid component, if used in larger quantity, might interfere with the absorption of liquid nonionic detergent sprayed onto the spray dried base beads, magnesium sulfate appears to be desirably absorbent, thereby helping to make the product free flowing.

In the aqueous crutcher mix the various dissolved compounds can ionize and therefore it may be considered that in the crutcher mix there are present magnesium, citrate and sulfate ions. Accordingly, crutcher mixes having charged thereto mixtures of compounds that result in the same ionic composition are also useful for retarding and preventing gelations of inorganic crutcher mixes. Thus, magnesium citrate or magnesium acid citrate could be employed, preferably with sodium sulfate, but also without the sulfate being present.

In accordance with the present invention, a miscible and pumpable crutcher slurry which does not prematurely set and which is capable of being mixed and pumped for a period of at least one or two hours after making, comprises from 40 to 70% of solids and 60 to 30% of water, of which solids content, on a 100% solids basis, about 55 to 85% is sodium bicarbonate, about 5 to 25% is sodium carbonate and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1:3 to 3:1, and the ratio of sodium bicarbonate:sodium silicate being within the range of about 3:1 to 10:1, and a gelation retarding proportion of a combination of 0.1 to 2% of a citric material selected from the group consisting of citric acid, water soluble citrate and mixtures thereof, and from 0.1 to 1.4% of magnesium sulfate, with the total of such citric material and magnesium sulfate, in combination, being gelation retarding and at least 0.4% of the slurry. The invention also relates to a method for retarding or preventing the gelation of a miscible and pumpable crutcher slurry of the general bicarbonate-carbonate-silicate type described, by addition thereto of a citric material and magnesium sulfate, in the described small quantities. The invention is also of similar products and methods wherein magnesium citrate is present as an anti-gelling material.

Without admitting that for the purpose of the Patent Law it is applicable prior art, it is recognized by the present inventor that prior to his invention the most preferred way of retarding gelation of bicarbonate-carbonate-silicate crutcher mixes in aqueous media was by the addition of small proportions of citric materials, as is described in U.S. patent application Ser. No. 81,799, filed Oct. 4, 1979 by Ronald S. Schreiber. Prior to Schreiber's work citric acid had been a known water softening or organic builder constituent of synthetic organic detergent compositions. Also, it had been suggested that magnesium salts might be added to synthetic detergent compositions or to wash waters containing them so as to increase foaming of anionic syndets in such media, and it was known that magnesium salts of some anionic detergents are water soluble. The problem of soluble silicates forming insoluble products in detergent compositions and in wash waters had been recognized and efforts had been made to prevent objectionable deposits of silicates on laundered articles. In some cases particular polyvalent metals had been utilized to "cap" alkali metal silicates to reduce polymerization thereof. Thus, for example, in recent U.S. Pat. No. 4,157,978, it is taught that a sodium or potassium silicate having an alkali metal oxide:silica ratio greater than 2 may be reacted with a water soluble salt of aluminum, titanium, zinc, zirconium, tin, vanadium, molybdenum, tungsten, selenium or germanium and the capped alkali metal silicate made may then be reacted with a water soluble material that will provide a carboxylate ion in aqueous solution. Among the various compounds of the mentioned metals that were suggested for reaction with the silicate there were included citrates. The mentioned patent does not suggest magnesium citrate nor does it suggest the combination of magnesium sulfate and citric acid or magnesium compound and water soluble citrate, e.g., sodium citrate or other alkali metal citrate. The crutcher mixes that are spray dried according to the teaching of the patent all include significant proportions of synthetic organic detergent; they are not builder salt crutcher mixes intended for later absorption of detergent. Thus, it appears that although the problem of gelling inorganic salt crutcher mixes has been recognized and the use of citric acid to ameliorate this condition was discovered by Schreiber, and although certain polyvalent metal salts were employed to cap silicates intended for use in detergent composition crutcher mixes to be spray dried, the art does not suggest or describe the use of a combination of citric material and magnesium sulfate (or magnesium citrate) in an inorganic salt base bead crutcher mix to prevent or retard gelation thereof. Neither does the art suggest the exceptionally good and unexpectedly beneficial anti-gelling effect of the combination of such materials of this invention, with the savings obtained in avoiding crutcher freezes and line blockages and in permitting the processing of higher solids content base bead crutcher mixes, with resulting energy savings and production capacity increases.

Although the anti-gelling features of the present invention may also be obtained with other inorganic builder base compositions than those which are primarily of bicarbonate, carbonate, silicate and water, the most significant anti-gelling effects are noted when crutcher mixes based substantially (preferably essentially) on such materials and water are treated by the method of this invention, i.e., addition of citric material and magnesium sulfate (or magnesium citrate). The compositions so treated comprise about 40 to about 70% of solids and are about 60 to about 30% of water. The solids contents, on a 100% solids bases, is about 55 to about 85% of sodium bicarbonate, about 5 to about 25% of sodium carbonate and about 5 to about 25% of sodium silicate, of $Na_2O:SiO_2$ ratio within the range of 1:1.4 to 1:3. In such compositions the ratio of sodium bicarbonate:sodium carbonate is within the range of about 2:1 to about 8:1, the ratio of sodium carbonate:sodium silicate is within the range of about 1:3 to about 3:1, and the ratio of sodium bicarbonate:sodium silicate is within the range of about 2:1 to about 10:1. The proportion of citric material, which is citric acid, water soluble citrate, mixture of such citrates or mixture of citric acid and such citrate(s), will be from about 0.1 to about 2% and the percentage of magnesium sulfate will be from 0.1 to 1.4%. The total of citric material and magnesium sulfate will be at least 0.4% and will usually not exceed 2.5 or 3%, with the percentages mentioned being on a total crutcher mix or slurry basis, including the mentioned salts, water and any adjuvants which may be present. A preferred range of such total is 0.5 to 3%, more preferably 0.6 to 2% and most preferably, usually, 0.7 to 1.2%. Although the employment of a combination of citric material, such as citric acid, and magnesium sulfate is preferable, there may be used in substitution for it from 0.3 to 3% of magnesium acid citrate ($M_gHC_6H_5O_7.5H_2O$) or equivalent proportion of equivalent magnesium citrate.

Preferably, the cruther slurry contains from 50 to 65% of solids, with the balance being water, and of the solids content, 55 to 80% is sodium bicarbonate, 10 to 25% is sodium carbonate and 10 to 25% is sodium silicate, with the ratio of sodium bicarbonate:sodium carbonate being in the range of 3:1 to 6:1, the ratio of sodium carbonate:sodium silicate being within the range of 2:5 to 5:2 and the ratio of sodium bicarbonate:sodium silicate being within the range of 4:1 to 8:1. More preferably, the crutcher slurry contains from 58 to 64% of solids and 42 to 36% of water, of which solids content 70 to 75% is sodium bicarbonate, 13 to 19% is sodium carbonate and 8 to 15% is sodium silicate. In such more preferred compositions the ratio of sodium bicarbonate:sodium carbonate is within the range of 4:1 to 5:1, the ratio of sodium carbonate:sodium silicate is within the range of 1:1 to 3:2 and the ratio of sodium bicarbonate:sodium silicate is within the range of 5:1 to 7:1. The materials described herein, except for water, are all normally solid and the percentages and ratios are on an anhydrous basis, although the various materials may be added to the crutcher as hydrates, or dissolved or dispersed in water. Normally, however, the sodium bicarbonate is anhydrous and the sodium carbonate is soda ash. Yet, the carbonate monohydrate may also be employed. The silicate is usually added to the crutcher slurry as an aqueous solution, normally of 40 to 50% solids content, e.g., 47.5%, and is preferably added near the end of the mixing process and after previous addings and dispersings and dissolvings of the citric material and magnesium sulfate (or magnesium citrate). The silicate employed will preferably be of $Na_2O:SiO_2$ ratio within the range of 1:1.6 to 1:2.6, more preferably 1:1.6 to 1:2.4 and most preferably 1:2.0 to 1:2.4.

Although it is highly preferred to make the crutcher slurry and the base bead product of this invention (from which a heavy duty built nonionic synthetic organic detergent composition can be produced) of essentially inorganic salts, in such manner that they will be of bead properties that promote absorption through the bead surfaces of nonionic detergent sprayed thereon in liquid form, and although often the adjuvants, such as perfumes, colorants, enzymes, bleaches and flow promoting agents, may be sprayed onto the beads with the nonionic detergent or may be post-added, for stable and normally solid adjuvants, mixing in with the inorganic salt slurry in the crutcher may be feasible. Thus, it is contemplated that from 0 to as much as 20% of the crutcher slurry may be of suitable adjuvants or diluents (diluents include inorganic salts, such as sodium sulfate and sodium chloride). However, if such adjuvants are present, normally the proportion thereof will be from 0.1 to 10% and often their content will be limited to 5%, and sometimes to 1 or 2%. Normally the organic material content of the crutcher slurry will be limited to about 5% maximum, preferably 3% maximum and most preferably 1 or 1.5% maximum, so as to avoid any problems of tackiness of the base beads after spray drying and to avoid any adverse effects on absorption of synthetic nonionic organic detergent by the beads. Because magnesium sulfate is inorganic and appears to be useful in aiding absorption of nonionic by the base beads and because it improves the anti-gelling activity of the citric material it allows the use of less citric material and thereby promotes the production of a more desirable final product.

The preferred combination gelation preventing materials employed, which have been found to be startlingly successful in preventing gelation, thickening, setting and freezing up of the crutcher slurry before it can be emptied from the crutcher and spray dried, using normal crutching, pumping and spray drying equipment, are citric material and magnesium sulfate. Because the crutcher slurry, including both dissolved and dispersed inorganic salts, is normally alkaline, usually being of a pH in the range of 9 to 12, preferably 10 to 11, when the citric material employed is citric acid it is considered to be ionized and converted to the corresponding citrate or brought into equilibrium with citrate ions. Thus, other soluble citrates may be employed instead of citric acid, including sodium citrate, potassium citrate and magnesium citrate, although for many applications the acid is considered to be superior. Instead of adding citrate, a mixture of the acid and a neutralizing agent, e.g., NaOH, KOH, $Mg(OH)_2$, may be used, and instead of the acid form, a citrate plus an acid can be substituted, if desired (although this latter course of action will rarely be followed). The proportion of citric material, in combination with magnesium sulfate will normally be only sufficient to accomplish the gelation preventing task in the particular crutcher slurry to be treated. However, for safety's sake an excess, e.g., 5 to 20% more than the sufficient quantities of citric material and magnesium sulfate, may be employed. While it is possible to use as much as 3.4% of the combination of citric material and magnesium sulfate, on a crutcher contents weight basis, to retard or prevent gelation, usually from 0.4 to 1.5% will suffice, preferably from 0.5 to 1.2%. When employing a citrate, such as an alkali metal citrate, one may wish to increase the percentage of the additive slightly to compensate for the presence of the heavier cation but for simplicity's sake the range of proportions of additives given will apply to both the acid and salt forms. With respect to the magnesium compound, the sulfate is highly preferred but this may be replaced by other sources of magnesium as by the magnesium ion in magnesium citrate, when that compound is used, preferably in proportion from 0.4 to 1.2% or 0.5 to 0.8%.

The order of addition of the various components to the crutcher is not considered to be critical, except that it is highly desirable to add the silicate solution last, and if not last, at least after the addition of the gel preventive combination of materials. Also, minor variations in orders of addition may be made under certain circumstances, as when objectionable foaming accompanies the following of a specific order. However, such problems have not been found to be serious. In some instances it is possible to premix the magnesium sulfate and citric material and to add the mixture thereof to the crutcher. In other cases the citric material is added first, followed by the magnesium sulfate, or vice versa. If desired, one or both of the citric material and magnesium sulfate may be premixed with another material or with other materials. In such instances it will be preferred for the anti-gelling additive components to be mixed in with other crutcher mix materials before addition of the silicate to the crutcher. However, in some instances one can add the anti-gelling materials after addition of the silicate, but preferably very promptly thereafter.

Usually, during the manufacture of the crutcher mix some water will be added to the crutcher initially, followed by some inorganic salt, either carbonate or bicarbonate, more water and more salt, and then, gel preventive materials and silicate, but dispersion-solutions of the individual components may be made beforehand, if feasible. The water employed may be city water of ordinary hardness. In theory, it is preferable to utilize deionized water or distilled water, if available, because some metallic impurities in the water may have a triggering action on gel formation, but that is not considered to be necessary.

The temperature of the aqueous medium in the crutcher will usually be elevated, normally to the 40° to 70° C. range and preferably will be from 50° to 60° C. Heating the crutcher medium promotes solution of the water soluble salts of the mix and thereby increases mix mobility. However, temperatures higher than 70° C. will usually be avoided because of the possibility of decomposition of one or more crutcher mix components, e.g., sodium bicarbonate. Heating of the crutcher mix, which may be effected by utilizing hot aqueous medium charged and by heating the crutcher contents by means of a heating jacket or heating coils, also helps to increase drying tower throughput because less energy has to be transferred to the sprayed droplets of crutcher mix in the tower. Using higher solids mixes also increases production.

Crutcher mixing times to obtain good slurries can vary widely, from as little as ten minutes for small crutchers and for slurries of higher moisture contents, to as much as four hours, in some cases. The mixing times needed to bring all the crutcher mix components together in one medium may be as little as five minutes but in some cases, can take up to an hour, although 30 minutes is a preferable upper limit. Counting any such initial admixing times, normal crutching periods will be from 20 minutes to two hours, e.g., 30 minutes to one hour, but the crutcher mix will be such as to be mobile, not gelled or set, for at least one hour, preferably for two hours and more preferably for four hours or so after completion of the making of the mix, e.g., 10 to 30 hrs.

The crutched slurry, with the various salts, dissolved or in particulate form, uniformly distributed therein, in part due to the desirable anti-gelling effects of the citric compound and the magnesium sulfate, is transferred in usual manner to a spray drying tower, which is located near the crutcher. The slurry is normally dropped from the bottom of the crutcher to a positive displacement pump, which forces it at high pressure through spray nozzles at the top of a conventional spray tower (countercurrent or concurrent), wherein the droplets of the slurry fall through a hot drying gas, which is usually composed of fuel oil or natural gas combustion products, in which the droplets are dried to desired absorptive bead form. During the drying, part of the bicarbonate is converted to carbonate, with the release of carbon dioxide, which appears to improve the physical characteristics of the beads made so that they become more absorptive of liquids, such as liquid nonionic detergent, which may be post sprayed onto them subsequently.

After drying, the product is screened to desired size, e.g., 10 to 100 mesh, U.S. Standard Sieve Series, and is ready for application of nonionic detergent spray thereto, with the beads being either in warm or cooled (to room temperature condition). However, the nonionic detergent will usually be at an elevated temperature to assure that it will be liquid; yet, upon cooling to room temperature, desirably it will be a solid, often resembling a waxy solid. The nonionic detergent, applied to the tumbling beads in known manner, as a spray or as droplets, is preferably a condensation product of ethylene oxide and higher fatty alcohol, with the higher fatty alcohol being of 10 to 20 carbon atoms, preferably of 12 to 16 carbon atoms, and more preferably averaging 12 to 13 carbon atoms, and with the nonionic detergent containing from 3 to 20 ethylene oxide groups per mole, preferably from 5 to 12, more preferably 6 to 8. The proportion of nonionic detergent in the final product will usually be from 10 to 25%, such as from 20 to 25%. Whereas when using citric acid alone as the anti-gelling agent, without the magnesium sulfate, the absorbency of the base beads would be good, with some base bead compositions and nonionic detergents it would be difficult to have more than 20% of the nonionic detergents satisfactorily absorbed by the base beads. It has been found that the present anti-gelling treatment, utilizing a mixture of citric material and magnesium sulfate, e.g., citric acid and magnesium sulfate, can result in beads of significantly greater absorbency, allowing absorption of 22% of nonionic detergent, with the production of a free flowing product and sometimes allowing absorption of as much as 25% of the nonionic detergent. In comparative tests against beads made using citric compound alone (citric acid) as the anti-gelling agent in the base bead crutcher mix, compositions of the present invention, made by the methods thereof, are more absorptive, as a general rule.

A preferred finished formulation made from base beads of this invention contains from 15 to 25%, preferably 20 to 25% of the nonionic detergent, e.g., Neodol 23-6.5, made by Shell Chemical Company, 30 to 40% of sodium bicarbonate, 20 to 30% of sodium carbonate, 5 to 15% of sodium silicate of $Na_2O:SiO_2$ ratio of 1:2.4, 1 to 3% of fluorescent brightener, 0.5 to 2% of proteolytic enzyme, sufficient bluing to color the product and whiten the wash, as desired, 0.5 to 3% of moisture, 0.5 to 1.2% of citric material, preferably sodium citrate and 0.8 to 2% of magnesium sulfate. Instead of the mixture of citric material and magnesium sulfate there may be present from 0.3 to 3% of magnesium citrate, preferably 0.4 to 1.2%. Optionally, sodium sulfate may be present, as a diluent, but the amounts thereof will normally be restricted to 20% preferably to 10% and most preferably to less than 5%, if it is present at all. The base beads made, devoid of nonionic detergent and adjuvants, will preferably comprise from 35 or 40 to 60% of sodium bicarbonate, 15, 20 or 25 to 45% of sodium carbonate, 10 to 20% of sodium silicate, 0.1 to 3% of sodium citrate +0.1 to 2% of magnesium sulfate (or 0.5 to 5% of magnesium citrate), 0 to 10% of adjuvant(s) and/or diluent(s) and 1 to 10% of moisture. In such products the proportion of sodium bicarbonate in the sprayed beads will normally be within the range of 1.2 to 4 times that of sodium carbonate, e.g., 1.5 to 3 times.

The highly beneficial result of incorporating the mentioned small percentages of citric compound and magnesium sulfate or magnesium citrate in the crutcher slurry in accordance with this invention is two-fold, gelation and setting of the crutcher mix in the vessel before complete discharge thereof is prevented and additionally, higher solids content crutcher slurries may be made. Thus, down times and cleanouts are eliminated and energy savings are achieved due to less water having to be evaporated from the crutcher droplets in the spray dryer. Although many bicarbonate-carbonate-silicate mixtures desirably employed in crutcher mixes for making base beads for built particulate nonionic detergent compositions would normally gel and set up in the crutcher, with the present invention, at little expense and without any detrimental effects on the product, the desired proportions of such builder salts can be employed and variations in such proportions can be made, as desired, without fear of freeze-ups of the crutcher. Tests of the final product show no adverse effects due to the presence of the citric material and magnesium sulfate therein. In fact, some positive results, due to metal ion sequestration and improved absorption of nonionic detergent, may result. The presence of the citric material is thought to promote maintenance of the stability of perfumes and colors present and it may help to prevent development of malodors from deteriorations of other organic additives, such as proteolytic enzymes and proteinaceous materials. The presence of the citric materials and the magnesium sulfate in the base beads also has the desirable effect of having the gelation preventing material present in any base beads or detergent beads being reworked, so that such material, if off-specification (as for being undersize of for being tower wall buildup), may be mixed with water and made into a more concentrated rework mix for subsequent blending back with the regular crutcher mix. Such mixing with water is easier than would be the case were the anti-gelling composition not present in the base beads to prevent or retard gelation or excessive thickening.

The following examples illustrate but do not limit the invention. Unless otherwise indicated all temperatures are by °C. and all parts are by weight in the examples and throughout the specification.

EXAMPLE 1

| Final Product Component | Percent |
|---|---|
| Nonionic Detergent (Neodol 23-6.5) | 18.6 |
| Proteolytic enzyme | 1.4 |
| Moisture | 1.5 |
| $NaHCO_3$ | 46.0 |
| $Na_2CO_3$ | 19.0 |
| Sodium silicate ($Na_2O:SiO_2$ = 1:2.4) | 10.9 |
| Sodium citrate | 0.9 |
| Magnesiun sulfate (as Epsom salt) | 0.8 |
| Adjuvants (fluorescent brightener, bluing, perfume) | 0.9 |
| | 100.0 |

A product of the above formula is made by spray drying a crutcher mix comprising sodium bicarbonate, sodium carbonate, sodium silicate, citric acid, magnesium sulfate, fluorescent brightener and water in a spray tower to produce essentially inorganic base beads, after which there is sprayed onto the surfaces of such beads a nonionic detergent in liquid state, solidifiable at room temperature, the beads and detergent are cooled and proteolytic enzyme powder and perfume are applied to them. The product made, of the formula given, is of a bulk density of 0.8 g./ml. and an initial adhesion of 40% and exhibits a fines characteristic (through U.S. Standard Sieve No. 50) of 15%.

The base beads are made by adding to the crutcher 308 parts of water, 15 parts of fluorescent brightener, 1.5 parts of blue pigment, 4.5 parts of anhydrous citric acid, 10 parts of magnesium sulfate (Epsom salt), 403 parts of sodium bicarbonate (anhydrous), 87.5 parts of soda ash, and 170 parts of a 47.5% solids content aqueous sodium silicate solution, the sodium silicate of which is of $Na_2O:SiO_2$ ratio of 1:2.4. During the mixing of this base builder composition the temperature in the crutcher is maintained at about 38° C. It takes about 20 minutes for the various materials to be mixed together in the order given (except that the brightener, pigment and citric acid are added in two parts, with the second halves being added after the soda ash), and after completion of addition of the last component the mixing is continued for about another 20 minutes, after which spray drying of the product is begun. Some of the crutcher mix is not sent to the spray dryer so that the time for gelation thereof may be measured. It is found that the crutcher mix remains miscible and pumpable, ungelled and uncongealed for 30 hours. The crutcher mix, which is pumped to the spray tower, using a Triplex positive displacement pump generating a pressure of about 30 kg./sq. cm., is dried in drying air, which is the combustion products of an oil burner, at a temperature ranging from a high of 400° to 600° C. to a low of about 100° to 200° C. and drying is to a moisture content of about 1.9%. The base beads resulting are screened so as to be within the 10 to 100 mesh U.S. Sieve Series range and are free flowing, non-tacky and of a bulk density of about 0.7 g./ml. They are porous, yet firm on the surfaces thereof and are capable of readily absorbing significant proportions of liquid nonionic detergent without becoming objectionably tacky. The detergent products made, including absorbed nonionic detergent, are excellent heavy duty laundry detergents, useful in washing household laundry in automatic washing machines and in cleaning textile materials by other methods, too.

In variations of this experiment, using the same proportions of all components except for water, citric acid and magnesium sulfate, when the amounts of such components are changed to 322, 3.5 and 10, respectively, the gelation time at 37.8° C. is found to be ten hours; when changed to 313, 4.5 and 5, respectively, it is eight hours; when changed to 307, 4.5 and 11.3, respectively, it is 7.5 hours; when changed to 314, 3.5 and 5, respectively, it is five hours; and when changed to 311, 2.5 and 10, respectively, it is four hours. Such crutcher mix compositions are of excellent stability and are very useful in commercial production of the present detergent base beads because they allow extra time before gelation, so that any "normal" problems associated with crutching and spray drying may usually be overcome before gelation or setting up in the crutcher could become a problem. When the mentioned proportions are 30.9, 2.5 and 11.3 or 317, 4.5 and 1, respectively, the crutching time, at 37.8° C., before gelation will be 3.5 hours and when the proportions are 316, 1.5 and 5 it will be 1.5 hours. Such formulations are also acceptable, especially the first two, because usually the contents of the crutcher can be completely sprayed out within 1.5 hours and almost always within 3.5 hours. However, it will usually be desirable to utilize more citric acid or magnesium sulfate or equivalent materials than the 1.5 and 5 parts mentioned, just to provide extra time against untoward incidents.

When the proportions of citric acid and/or magnesium sulfate and/or the sum thereof are outside the ranges given in the specification, premature gelation occurs or a satisfactory dispersion is not made. For example, when 30.2 parts of water, 2.5 parts of citric acid and 19 parts of magnesium sulfate are employed the product gels immediately, which also occurs when 304 parts of water, 0.5 part of citric acid and 19 parts of magnesium sulfate are utilized, or when such proportions are 304, 3.5 and 15 or 306, 1.5 and 15. Gelation occurs within about 25 minutes when the proportions are 321, 0.5 and 1 and within about 20 minutes when they are 313, 0.5 and 10. Thus, it can be seen that the compositions of the present invention, made by the described methods, are especially useful in the preparation of spray dried base builder beads for heavy duty laundry detergents, without the danger of premature gelation of the crutcher mix.

When sodium citrate is substituted for citric acid in the formulas given above, with the magnesium sulfate being either anhydrous or in Epsom salt, similar results are obtained. Also, when equivalent proportions of magnesium citrate are employed, whether $Mg_2$(citrate)$_3$ or $MgHC_6H_5O_7.5H_2O$, e.g., 1.5% good anti-gelling effects are obtained, although they are not as good as those for the combination of citric acid (or sodium citrate) and magnesium sulfate.

The crutcher mixes of this invention may be of greater solids contents than those for similar compositions in which a sufficient quantity of citric acid is employed (without the magnesium sulfate) to obtain the same (or somewhat inferior) anti-gelling effects. Thus, the presence of the magnesium sulfate with the citric acid appears to improve the anti-gelling effects so that even higher contents of solids may be present in the crutcher slurries without gelation. In the past it has been found that solids content and gelation tendencies were directly proportional and this is also the case when combinations of citric acid and magnesium sulfate are employed. Still, one can utilize higher solids content crutcher mixes without objectionable gelling, whereas similar mixes, when treated with citric acid alone, could gel prematurely. Also, when the citric acid-magnesium sulfate mixture is employed the content of organic material in the product may be minimized, while still maintaining the crutcher slurry miscible for sufficiently long periods of time to avoid crutcher set-ups or line blockages.

EXAMPLE 2

In comparative experiments a crutcher mix formulation is made essentially like that of the crutcher mix which results in a base bead for making a detergent composition of the formula first given in Example 1, but with the solids content of the crutcher mix being kept at 56.5%. The mix is made in the same manner and the crutching times up to objectionable gelation are measured when various materials are added with the citric acid as anti-gelling agents, in replacement of the magnesium sulfate. Using 0.25% of citric acid and 1% of each of such other anti-gelling "salt" additives, on an anhydrous basis, the slurry fluidity is maintained for only about 20 minutes when either sodium chloride or calcium chloride is the salt employed, which is about the same time for which fluidity is maintained when the citric acid is used alone. With sodium sulfate as the salt added the slurry life is extended to 1.5 hours and calcium sulfate allows mixing for up to five hours. Magnesium silicate results in an initially thin slurry, which solidifies in about five hours. Calcium oxide and magnesium oxide make very highly viscous slurries which solidify in a few hours. Magnesium chloride extends the slurry life to ten hours and magnesium sulfate extends it to more than 32 hours. However, when various heat stable adjuvants are present in the crutcher mix, such as bluing, fluorescent brightener and other normal detergent adjuvants for crutcher mixes, it has been found that gelation is accelerated, sometimes occurring in one-tenth to one-half the time normally taken. Thus, since it is desirable that at least an hour be provided before gelation and preferably, that more time should be available, none of the anti-gelling salts except the magnesium chloride and magnesium sulfate is considered to be useful and of these two the magnesium sulfate is clearly superior. On the basis of above experiments it is within the invention to utilize magnesium chloride with citric acid or to employ a mixture of magnesium chloride and magnesium sulfate with citric acid.

EXAMPLE 3

The experiment of Example 2 is repeated but the order of addition of the detergent builder salt components to the crutcher is altered so that the bicarbonate, carbonate and silicate are mixed together in the aqueous medium before addition thereto of the magnesium sulfate and citric acid. In such case, after a few minutes the mix becomes objectionably thick and solidifies in an irreversible manner. However, if as it is noted that the mix is thickening, the magnesium sulfate component or the magnesium sulfate-citric acid anti-gelling composition is quickly added at that time, before solidification, it will thin the mix to a workable state. This is another advantage of the present invention because, in addition to extending the crutching time, it allows control of the fluidity of the crutcher mix in response to indications of gelation, as they appear. Thus, the crutcher operator has improved processing control during the period in which the mix is held in the crutcher before spray drying. Should there be some interruption of spray tower operation, neccesitating holding the mix longer in the crutcher than planned, he can extend the period of miscibility of the crutcher mix by further addition of magnesium sulfate and citric acid or equivalent anti-gelling agent(s) of this invention or magnesium sulfate alone, in many instances. For example, it has been found that often as little as 0.3% of $MgSO_4$ or 0.6% of Epsom salt will reverse gelation, providing that the mix it still fluid enough to permit mixing in of the magnesium salts. Normally, from 0.3 to 1% of $MgSO_4$ will be added. This feature of the invention allows minimizing of the magnesium sulfate and citric acid contents of the product, so that product characteristics will not be changed noticeably, and yet assures the operator that he will not have to dig solidified crutcher mix out of the crutcher, with the waste of material and loss of production time that would be involved. This improvement in the manufacturing process is important because if the crutcher mix solidifies, spray tower operation can be halted, essentially shutting down the detergent manufacturing operation. When operations are restarted even when that is done reasonably promptly after gelling first occurs, the spray tower will have to be brought to equilibrium, and during the first part of such resumed manufacturing some unacceptable product can result. Sometimes gelation in the crutcher is not so extensive as to solidify the mass of mix but still the production of some gel can block spray nozzles and cause interruption of production. Such adverse effects are avoided by use of the present process, as herein described.

EXAMPLE 4

An attempt is made to make a crutcher mix of the type described in Example 2, utilizing 0.25% of citric acid and 1% of magnesium sulfate (anhydrous), with the order of addition of the various components being changed so that the water, silicate, magnesium sulfate and citric acid are first mixed together, after which the bicarbonate and carbonate are added, plus the fluorescent dye and pigment. However, such crutcher mixes gel prematurely and for that reason the mentioned order of addition is unsatisfactory. The experiment was repeated several times but in all cases the crutcher mix froze so that it could not be stirred, pumped and spray dried.

EXAMPLE 5

Attempts were made to manufacture in laboratory equipment crutcher mixes containing high solids contents. Thus using the basic formulas previously given, with 0.25% of citric acid and 1% of magnesium sulfate, and adding the components in the operative order described in Examples 1 and 2, the builder salt composition was 70% of sodium bicarbonate, 20% of soda ash and 10% of sodium silicate in one instance, 77%, 13% and 10% in the second and 67%, 23% and 10% in the third, so that the bicarbonate;carbonate ratios were 3.5:1, 6:1 and 3:1, respectively. Such products could not be made in laboratory equipment but are makable, especially with additional magnesium sulfate and citric acid, up to twice as much as being employed initially, when heavy duty plant equipment is utilized.

In a similar manner three other formulations were made, lower in solids content, comprising 56%, 19% and 25% in the one case, 60%, 15% and 25% in the second case and 60%, 20% and 20% in the third case, of sodium bicarbonate, soda ash and sodium silicate, so that the bicarbonate: carbonate ratios are 3:1, 4:1 and 3:1, respectively. Such products are very easily manufactured, even in laboratory equipment, but because of the need to evaporate more water during the spray drying process they are not as economically feasible as higher solids content crutcher mixes. In the described experiments the silicate is that of Example 1.

From the above experiments it is seen that the present invention is an important one. The anti-gelling materials being employed allow the use of higher solids content crutcher mixes and thereby conserve energy (less drying air needed) and increase throughputs. The invention also ensures the crutcher mix freeze-ups do not occur, with the loss of time and materials that would otherwise result. Operations at higher crutcher temperatures are permissible despite the fact that increasing such temperatures would otherwise increase the probability of gelation of the crutcher mix. The magnesium salt anti-gelling agents improve product characteristics to a significant extent and although one will usually attempt to minimize the citric acid or other citric material content, the presences of such materials have good effects, too. It appears from the experimental results that the solids content of the crutcher mix may be as high as 70% in some circumstances and good mixing and sufficiently delayed gelation are obtainable by means of the present invention, despite such high solids contents. Also, the crutcher mix temperature may go as high as 70° C. Of course, at such higher solids contents and temperatures stronger mixing would usually be used and often more anti-gelling agent will be present.

The invention has been described with respect to various illustrations and embodiments thereof but is not to be limited to these because it is evident that one of skill in the art, with the present specification before him, will be able to utilize equivalents and substitutes without departing from the invention.

What is claimed is:

1. A method of retarding or preventing the gelation of a miscible and pumpable crutcher slurry containing from about 40 to 70% of solids and 60 to 30% of water, of which solids content, on a 100% solids basis, about 55 to 85% is sodium bicarbonate, about 5 to 25% is sodium carbonate, and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1:3 to 3:1, and the ratio of sodium bicarbonate:-sodium silicate being within the range of about 2:1 to 10:1, which comprises preparing a crutcher slurry of the described composition containing from 0.1 to 2% of a citric material selected from the group consisting of citric acid, water soluble citrate and mixtures thereof, and from 0.1 to 1.4% of magnesium sulfate, with the total of such citric material and magnesium sulfate, in combination, being gelation retarding and at least 0.4% of the slurry, and mixing such composition in the crutcher during preparation thereof.

2. A method according to claim 1 wherein the crutcher slurry contains from 50 to 65% of solids and 50 to 35% of water, of which solids content 55 to 80% is sodium bicarbonate, 10 to 25% is sodium carbonate and 5 to 25% is sodium silicate of $Na_2O:SiO_2$ ratio within the range of 1:1.6 to 1:2.6, the ratio of sodium bicarbonate:sodium carbonate is within the range of 3:1 to 6:1, the ratio of sodium carbonate:sodium silicate is within the range of 2:5 to 5:2 and the ratio of sodium bicarbonate:sodium silicate is within the range of 4:1 to 8:1, and wherein the percentages of gelation preventing citric material and magnesium sulfate are in the ranges of 0.2 to 0.8 and 0.2 to 1.2, respectively.

3. A method according to claim 2 wherein the crutcher slurry is at a temperature in the range of 35 to 70° C., at atmospheric pressure, and the citric material and magnesium sulfate are incorporated in the slurry before addition thereto of at least some of the sodium silicate.

4. A method according to claim 3 wherein the crutcher slurry contains from 58 to 64% of solids and 42 to 36% of water, of which solids content 70 to 75% is sodium bicarbonate, 13 to 19% is sodium carbonate and 8 to 15% is sodium silicate of $Na_2O:SiO_2$ ratio within the range of 1:1.6 to 1:2.4, the ratio of sodium bicarbonate:sodium carbonate is within the range of 4:1 to 5:1, the ratio of sodium carbonate:sodium silicate is within the range of 1:1 to 3:2 and the ratio of sodium bicarbonate:sodium silicate is within the range of 5:1 to 7:1, and wherein the percentages of gelation preventing citric material and magnesium sulfate are in the ranges of 0.25 to 0.6 and 0.4 to 1.0, respectively.

5. A method according to claim 1 wherein mixing is at an elevated temperature, in the range of 40° to 70° C., the citric material and magnesium sulfate are incorporated in the slurry before the sodium silicate, and mixing is continued for at least one hour after completion of the making of the crutcher slurry.

6. A method according to claim 4 wherein the crutcher slurry temperature is from 40° to 60° C., mixing is effected at least two hours after completion of the making of the crutcher slurry, and at least a part of the crutcher mix is pumped out of the crutcher to a spray drying tower and is spray dried therein after said mixing after said two hours.

7. A method according to claim 6 wherein citric acid is the gelation preventing citric material in the crutcher slurry.

8. A method according to claim 6 wherein sodium citrate is the gelation preventing citric material in the crutcher slurry.

9. A method according to claim 1 wherein citric acid is the gelation preventing citric material in the crutcher slurry.

10. A method according to claim 1 wherein sodium citrate is the gelation preventing citric material in the crutcher slurry.

11. A method according to claim 1 wherein from 0.1 to 10% of the crutcher slurry is of adjuvant(s) and/or diluent(s).

12. A miscible and pumpable crutcher slurry comprising from 40 to 70% of solids and 60 to 30% of water, of which solids content, on a 100% solids basis, about 55 to 85% is sodium bicarbonate, about 5 to 25% is sodium carbonate and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1:3 to 3:1, and the ratio of sodium bicarbonate:-sodium silicate being within the range of about 2:1 to 10:1, and a gelation retarding proportion of a combination of 0.1 to 2% of a citric material selected from the group consisting of citric acid, water soluble citrate and mixtures thereof, and from 0.1 to 1.4% of magnesium sulfate, with the total of such citric material and magnesium sulfate, in combination, being gelation retarding and at least 0.4% of the slurry.

13. A crutcher slurry according to claim 12 comprising 50 to 65% of solids and 50 to 35% of water, of which solids content 55 to 80% is sodium bicarbonate, 10 to 25% is sodium carbonate and 5 to 25% is sodium silicate of $Na_2O:SiO_2$ ratio within the range of 1:1.6 to 1:2.6, in which the ratio of sodium bicarbonate:sodium carbonate is within the range of 3:1 to 6:1, the ratio of sodium carbonate:sodium silicate is within the range of 2:5 to 5:2 and the ratio of sodium bicarbonate:sodium silicate is within the range of 4:1 to 8:1, and wherein the percentages of gelation preventing citric material and magnesium sulfate are in the ranges of 0.2 to 8 and 0.2 to 1.2, respectively.

14. A crutcher slurry according to claim 13 comprising from 58 to 64% of solids and 42 to 36% of water, of which solids content 70 to 75% is sodium bicarbonate, 13 to 19% is sodium carbonate and 8 to 15% is sodium silicate of $Na_2O:SiO_2$ ratio within the range of 1:1.6 to 1:2.4, in which the ratio of sodium bicarbonate:sodium carbonate is within the range of 4:1 to 5:1, the ratio of sodium carbonate:sodium silicate is within the range of 1:1 to 3:2 and the ratio of sodium bicarbonate:sodium silicate is within the range of 5:1 to 7:1, and wherein the percentages of gelation preventing citric material and magnesium sulfate are in the ranges of 0.25 to 0.6 and 0.4 to 1.0, respectively.

15. A crutcher slurry according to claim 14 containing from 0.1 to 10% of adjuvant(s) and/or diluent(s).

16. A method of making a particulate base material in bead form, suitable for absorbing nonionic detergent to make a built heavy duty synthetic organic detergent composition, which comprises making a miscible and pumpable slurry in a crutcher by the method of claim 1, pumping the slurry out of the crutcher in ungelled and readily pumpable state and spray drying the slurry to particulate bead form, during which spray drying a portion of the sodium bicarbonate is converted to sodium carbonate.

17. A product of the process of claim 16.

18. A product according to claim 17 comprising from about 40 to 60% of sodium bicarbonate, 15 to 45% of sodium carbonate, 10 to 20% of sodium silicate, 0.1 to 3% of sodium citrate, 0.1 to 2% of magnesium sulfate, 0 to 10% of adjuvant(s) and/or diluent(s) and 1 to 10% of moisture, with the proportion of sodium bicarbonate being from 1.2 to 4 times that of sodium carbonate.

19. A method of retarding or preventing the gelation of a miscible and pumpable crutcher slurry containing from about 40 to 70% of solids and 60 to 30% of water, of which solids content, on a 100% solids basis, about 55 to 85% is sodium bicarbonate, about 5 to 25% is sodium carbonate and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1:3 to 3:1, and the ratio of sodium bicarbonate:-sodium silicate being within the range of about 2:1 to 10:1, which comprises preparing a crutcher slurry of the described composition, in which there was included from 0.3 to 3% of magnesium citrate or acid citrate, and mixing such composition in the crutcher during preparation thereof.

20. A method according to claim 19 wherein the crutcher slurry contains from 50 to 65% of solids and 50 to 35% of water, of which solids content 55 to 80% is sodium bicarbonate, 10 to 25% is sodium carbonate and 5 to 25% is sodium silicate of $Na_2O:SiO_2$ ratio within the range of 1:1.6 to 1:2.6, the ratio of sodium bicarbonate:sodium carbonate is within the range of 3:1 to 6:1, the ratio of sodium carbonate:sodium silicate is within the range of 2:5 to 5:2 and the ratio of sodium bicarbonate:sodium silicate is within the range of 4:1 to 8:1, and wherein the percentage of magnesium citrate is in the range of 0.3 to 1.2.

21. A miscible and pumpable crutcher slurry comprising from from 40 to 70% of solids and 60 to 30% of water, of which solids content, on a 100% solids basis, about 55 to 85% is sodium bicarbonate, about 5 to 25% is sodium carbonate and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1:3 to 3:1, and the ratio of sodium bicarbonate:-sodium silicate being within the range of about 2:1 to 10:1, and a gelation retarding proporation of magnesium citrate, from 0.3 to 3% of the slurry.

22. A crutcher slurry according to claim 21 comprising 50 to 65% of solids and 50 to 35% of water, of which solids content 55 to 80% is sodium bicarbonate, 10 to 25% is sodium carbonate and 5 to 25% is sodium silicate of $Na_2O:SiO_2$ ratio within the range of 1:1.6 to 1:2.6, the ratio of sodium bicarbonate:sodium carbonate is within the range of 3:1 to 6:1, the ratio of sodium carbonate:sodium silicate is within the range of 2:5 to 5:2 and the ratio of sodium bicarbonate:sodium silicate is within the range of 4:1 to 8:1, and wherein the percentage of gelation preventing magnesium citrate is in the range of 0.3 to 1.2.

* * * * *